US011265637B2

(12) United States Patent
Kunimoto et al.

(10) Patent No.: US 11,265,637 B2
(45) Date of Patent: Mar. 1, 2022

(54) BONE-CONDUCTION MICROPHONE

(71) Applicant: PANASONIC INTELLECTUAL PROPERTY MANAGEMENT CO., LTD., Osaka (JP)

(72) Inventors: Hiroshi Kunimoto, Osaka (JP); Suguru Nakao, Hyogo (JP); Kei Tasaka, Osaka (JP); Katsuo Saigou, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/183,236

(22) Filed: Feb. 23, 2021

(65) Prior Publication Data

US 2021/0176552 A1 Jun. 10, 2021

Related U.S. Application Data

(63) Continuation of application No. PCT/JP2019/033327, filed on Aug. 26, 2019.

(30) Foreign Application Priority Data

Aug. 30, 2018 (JP) ..... JP2018-161597

(51) Int. Cl.
*H04R 1/10* (2006.01)
*H01R 13/70* (2006.01)
*H04R 17/02* (2006.01)

(52) U.S. Cl.
CPC ..... *H04R 1/1008* (2013.01); *H01R 13/70* (2013.01); *H04R 1/1041* (2013.01); *H04R 17/02* (2013.01);
(Continued)

(58) Field of Classification Search
CPC ..... H04R 1/08; H04R 1/406; H04R 1/342; H04R 1/38; H04R 1/04; H04R 1/14;
(Continued)

(56) References Cited

U.S. PATENT DOCUMENTS 4,591,668 A * 5/1986 Iwata ..... H04R 1/46 381/151
6,326,539 B1 * 12/2001 Mishima ..... G10H 3/14 36/139
(Continued)

FOREIGN PATENT DOCUMENTS

JP H0833073 A * 2/1996 ..... H04R 1/10
JP 2504115 B2 6/1996
(Continued)

OTHER PUBLICATIONS

International Search and Written Opinion issued in International Patent Application No. PCT/JP2019/033327, dated Sep. 17, 2019; with partial English translation.

*Primary Examiner* — Ahmad F. Matar
*Assistant Examiner* — Sabrina Diaz
(74) *Attorney, Agent, or Firm* — McDermott Will and Emery LLP

(57) ABSTRACT

A bone conduction microphone includes a housing having an opening, a microphone pad, an element support member, a piezoelectric element, and a drive plate. The microphone pad is formed in a bottomed tubular shape having a bottom portion disposed outward and a tubular portion with an outer circumference fixed to an inner circumference of the opening. The element support member has an outer circumference fixed to an inner circumference of the tubular portion, and a support portion projecting toward the bottom portion. The piezoelectric element is in a plate shape with a peripheral edge of one surface fixed to the support portion and picks up vibration. The drive plate has a diaphragm part
(Continued)

fixed to an inward surface of the bottom portion, and the diaphragm part is provided at a center with a protrusion fixed to an element central portion on another surface of the piezoelectric element.

9 Claims, 6 Drawing Sheets

(52) U.S. Cl.
CPC ..... *H04R 2400/03* (2013.01); *H04R 2460/13* (2013.01)

(58) Field of Classification Search
CPC ..... H04R 1/46; H04R 1/083; H04R 1/086; H04R 1/105; H04R 1/1066; H04R 1/24; H04R 1/403; H04R 1/26; H04R 1/1008; H04R 1/1041; H04R 3/00; H04R 3/005; H04R 3/04; H04R 2460/13; H04R 11/00; H04R 25/606; H04R 19/04; H04R 19/016; H04R 9/063; H04R 5/02; H04R 13/70; H04R 17/02; H04R 2400/03; H04M 1/03; H04M 1/05; F16M 13/04; A62B 18/08
USPC ..... 381/182, 91, 122, 151, 369, 355, 361, 381/364, 367
See application file for complete search history.

(56) References Cited

U.S. PATENT DOCUMENTS

| | | | | |
|---|---|---|---|---|
| 10,828,007 | B1 * | 11/2020 | Telfort | A61B 5/0205 |
| 2001/0045320 | A1 | 11/2001 | Sugiyama et al. | |
| 2005/0197565 | A1 * | 9/2005 | Yagi | G01R 33/283 600/418 |
| 2011/0319021 | A1 * | 12/2011 | Proulx | H04R 17/02 455/41.2 |
| 2018/0352348 | A1 * | 12/2018 | Aoyagi | H04R 7/18 |
| 2019/0253547 | A1 | 8/2019 | Kunimoto et al. | |
| 2019/0253786 | A1 | 8/2019 | Nakao et al. | |
| 2019/0253809 | A1 | 8/2019 | Kunimoto et al. | |

FOREIGN PATENT DOCUMENTS

| | | | | |
|---|---|---|---|---|
| JP | H1079999 | A * | 3/1998 | H04R 17/02 |
| JP | H10-117394 | A | 5/1998 | |
| JP | 2000-261875 | A | 9/2000 | |
| JP | 2001-292487 | A | 10/2001 | |
| JP | 4130443 | B2 | 8/2008 | |
| WO | 2018/079575 | A1 | 5/2018 | |

* cited by examiner

BONE-CONDUCTION MICROPHONE

CROSS-REFERENCE OF RELATED APPLICATIONS

This application is a Continuation of International Patent Application No. PCT/JP2019/033327, filed on Aug. 26, 2019, which in turn claims the benefit of Japanese Application No. 2018-161597, filed on Aug. 30, 2018, the entire disclosures of which Applications are incorporated by reference herein.

BACKGROUND

1. Technical Field

The present disclosure relates to a bone conduction microphone.

2. Description of the Related Art

Bone conduction microphones that convert vocal cord vibration into voice signals are known. The bone conduction microphone of Patent Literature (PTL) 1 has a vibration acquisition unit that comes into contact with a human body and acquires vibration in a predetermined direction included in vocal cord vibration, and a switch that switches whether to acquire vibration in a predetermined direction. The switch is disposed on a side opposite to a side on which the vibration acquisition unit comes into contact with the human body such that a direction of operation for switching whether to acquire vibration is parallel to the predetermined direction.

PTL 1 is International Publication No. WO 2018/079575.

SUMMARY

An object of the present disclosure is to provide a bone conduction microphone that increases a potential level output by a piezoelectric element and suppresses an occurrence of a phenomenon in which vibration caused by pressing a call button is heard by the other party as an unpleasant sound.

The bone conduction microphone of the present disclosure includes a housing having an opening, a microphone pad, an element support member, a piezoelectric element, and a drive plate. The microphone pad is formed in a bottomed tubular shape having a bottom portion disposed outward and a tubular portion with an outer circumference fixed to an inner circumference of the opening. The element support member has an outer circumference fixed to an inner circumference of the tubular portion, and a support portion projecting toward the bottom portion. The piezoelectric element is in a plate shape with a peripheral edge of one surface fixed to the support portion and picks up vibration. The drive plate has a diaphragm part fixed to an inward surface of the bottom portion, and the diaphragm part is provided at a center with a protrusion fixed to an element central portion on another surface of the piezoelectric element.

According to the bone conduction microphone of the present disclosure, a potential level output by the piezoelectric element can be increased, and an occurrence of the phenomenon in which vibration caused by pressing a call button is heard by the other party as an unpleasant sound can be suppressed, in a bone conduction headset.

DETAILED DESCRIPTION (Background to contents of an exemplary embodiment of the present disclosure) Conventional bone conduction microphones each have structure in which the entire surface of a built-in piezoelectric element is attached and fixed to a microphone pad (so-called full-surface attachment structure). This causes a problem in which the amount of deformation (in other words, the amount of deflection) of the piezoelectric element decreases to reduce a potential level detected by pharyngeal vibration based on utterance of a wearer of the bone conduction microphone, and thus voice of the wearer is less likely to be heard by the other party. There is another problem in that when a call button to be pressed for conversation is pressed to talk with the other party, vibration caused when the wearer of the bone conduction microphone presses the call button is heard by the other party as an unpleasant sound.

Thus, a first exemplary embodiment below describes an example of a bone conduction microphone that increases a potential level detected by a piezoelectric element as compared with the conventional bone conduction microphones (conventional structure) described above, and suppresses an occurrence of the phenomenon in which vibration caused by pressing a call button is heard by the other party as an unpleasant sound.

Hereinafter, an exemplary embodiment specifically disclosing structure and operation of the bone conduction microphone according to the present disclosure will be described in detail with reference to the drawings as appropriate. However, an unnecessarily detailed description may be eliminated. For example, detailed description of a well-known item or duplicated description of substantially identical structure may be eliminated. This is to prevent the following description from being unnecessarily redundant to facilitate understanding of those skilled in the art. The attached drawings and the following description are provided for those skilled in the art to fully understand the present disclosure, and are not intended to limit the subject matter described in the scope of claims.

The bone conduction microphone of the present disclosure is used for talking with a remote party using wireless communication in a noisy environment such as a construction site, for example. The bone conduction microphone acquires vocal cord vibration emitted from a human body by bone conduction when a part of the bone conduction microphone is pressed against the jaw or the throat of the human body.

Figure 1:
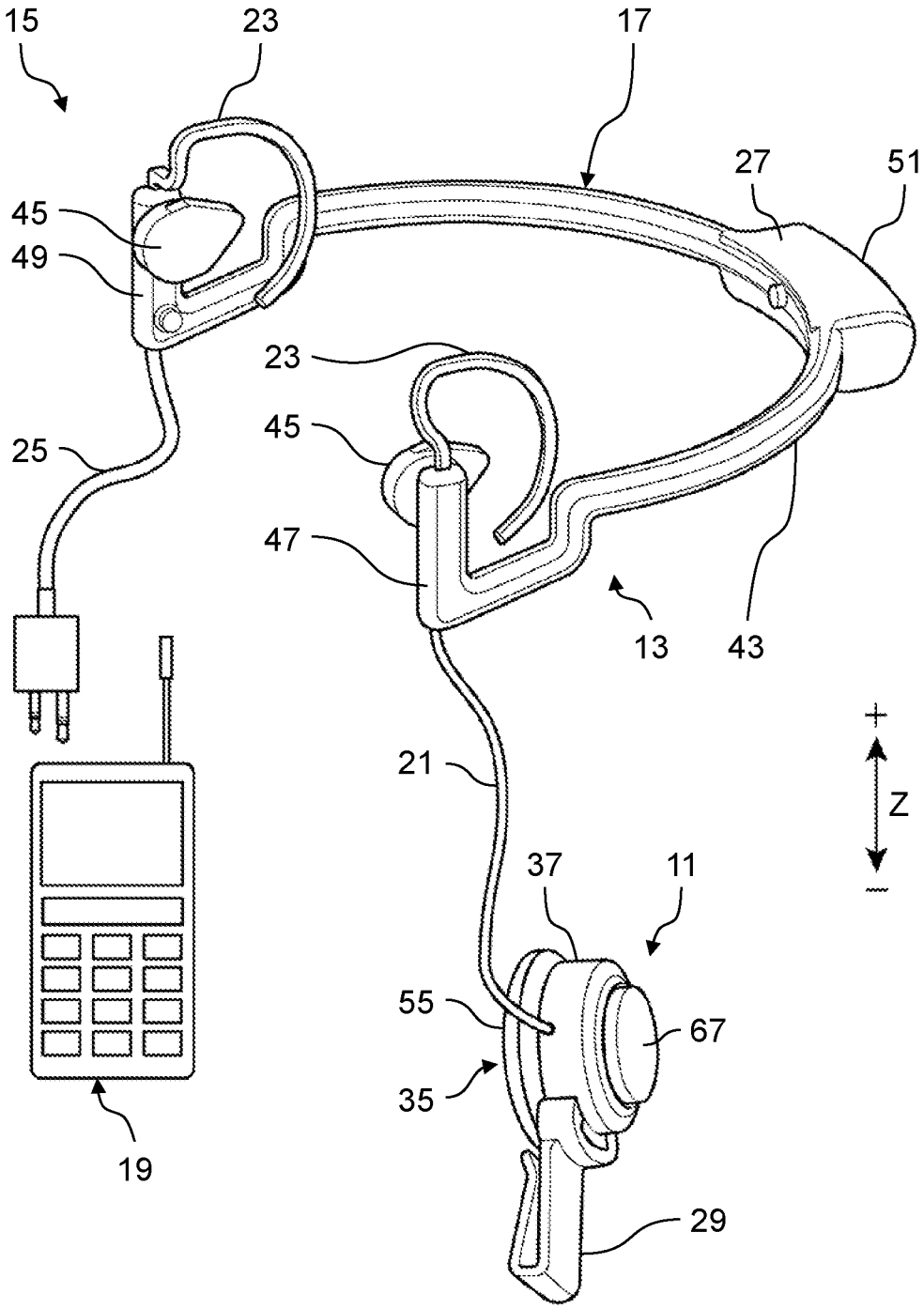
FIG. 1 is a perspective view of a bone conduction headset provided with a bone conduction microphone according to a first exemplary embodiment.

FIG. 1 is a perspective view of bone conduction headset 13 provided with bone conduction microphone 11 according to the first exemplary embodiment. Communication device 15 includes bone conduction headset 13 having bone conduction microphone 11 and headset body 17, and transceiver 19. Bone conduction microphone 11 is connected to headset body 17 using microphone cable 21. Headset body 17 has ear hook 23, and ear hook 23 is worn on a head by being hung on an ear of a human body (i.e., a wearer). Headset body 17 is connected to transceiver 19 using headset cable 25. Transceiver 19 is worn on, for example, a part of clothing of the wearer and communicates with an external device owned by the other party (i.e., a communication partner). Bone conduction microphone 11 may be connected to controller 27 of headset body 17, or may be connected to transceiver 19 to directly input a signal to transceiver 19 without being connected to controller 27.

Figure 2:
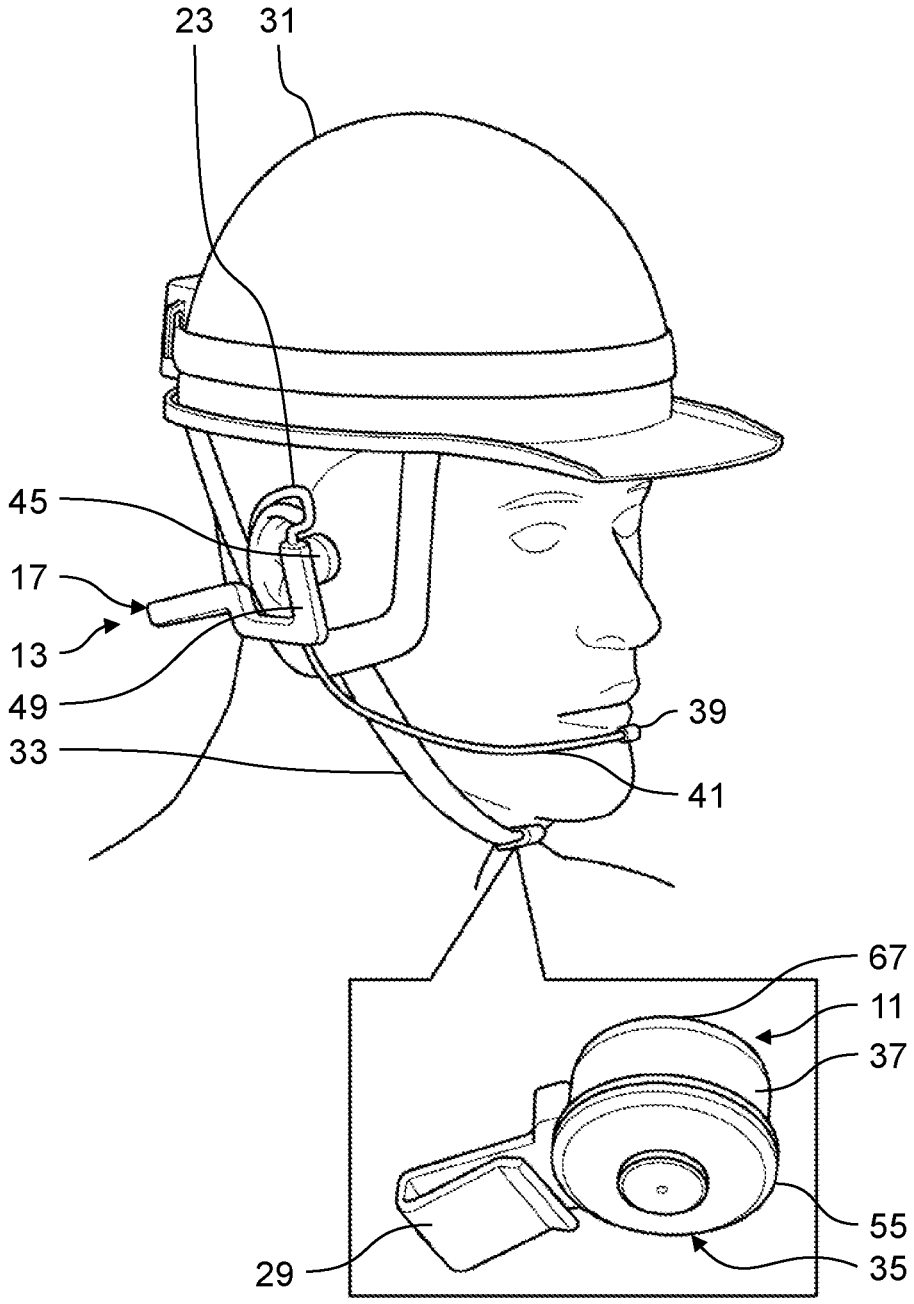
FIG. 2 is a perspective view of an example of a usage state of the bone conduction headset illustrated in FIG. 1 together with an enlarged view of the bone conduction microphone.

FIG. 2 is a perspective view of an example of a usage state of bone conduction headset 13 illustrated in FIG. 1 together with an enlarged view of bone conduction microphone 11. Bone conduction microphone 11 is worn on chin strap 33 of helmet 31 using fastener 29. Bone conduction microphone 11 includes vibration acquisition unit 35 that comes into contact with the human body (i.e., the wearer) and acquires vocal cord vibration based on utterance of the wearer, and housing 37 that supports vibration acquisition unit 35. When a voice is input using bone conduction microphone 11, the wearer grasps bone conduction microphone 11 and brings vibration acquisition unit 35 into contact with the jaw or throat thereof. This causes bone conduction microphone 11 to acquire vocal cord vibration. When no voice is input, bone conduction microphone 11 is suspended from chin strap 33.

Bone conduction headset 13 includes voice microphone 39 that acquires a sound through air, and microphone holder 41 that supports voice microphone 39. For example, bone conduction microphone 11 is used in a noisy environment, and voice microphone 39 is used in a non-noise environment. Bone conduction microphone 11 and voice microphone 39 are selectively used by being switched. Voice microphone 39 is not illustrated in FIG. 1, and microphone cable 21 is not illustrated in FIG. 2.

Headset body 17 includes support 43 and a pair of speakers 45. Support 43 has a U-shape, and has opposite end portions (end portion 47, end portion 49) facing each other and central portion 51 located between the opposite end portions (end portion 47, end portion 49). Central portion 51 of support 43 refers to a portion near the center when support 43 is viewed along the U-shape. Paired speakers 45 are supported at the corresponding opposite end portions (end portion 47, end portion 49) to face each other. Support 43 is connected at one end portion 47 to bone conduction microphone 11 using microphone cable 21. As illustrated in FIG. 2, support 43 is connected at other end portion 49 to voice microphone 39 using microphone holder 41.

Support 43 is mainly made of a resin material, and is provided inside with an elastic wire aggregate. Support 43 is further provided inside with wiring for connecting bone conduction microphone 11, voice microphone 39, controller 27, speaker 45, and the like. Support 43 has the opposite end portions (end portion 47, end portion 49) that are each in a columnar shape extending vertically (Z direction), and paired speakers 45 are each provided on an upper side (a plus side in the Z direction) of the corresponding one of the opposite end portions (end portion 47, end portion 49). The opposite end portions (end portion 47, end portion 49) are each provided with ear hook 23. Support 43 includes central portion 51 in which controller 27 is incorporated.

Figure 3:
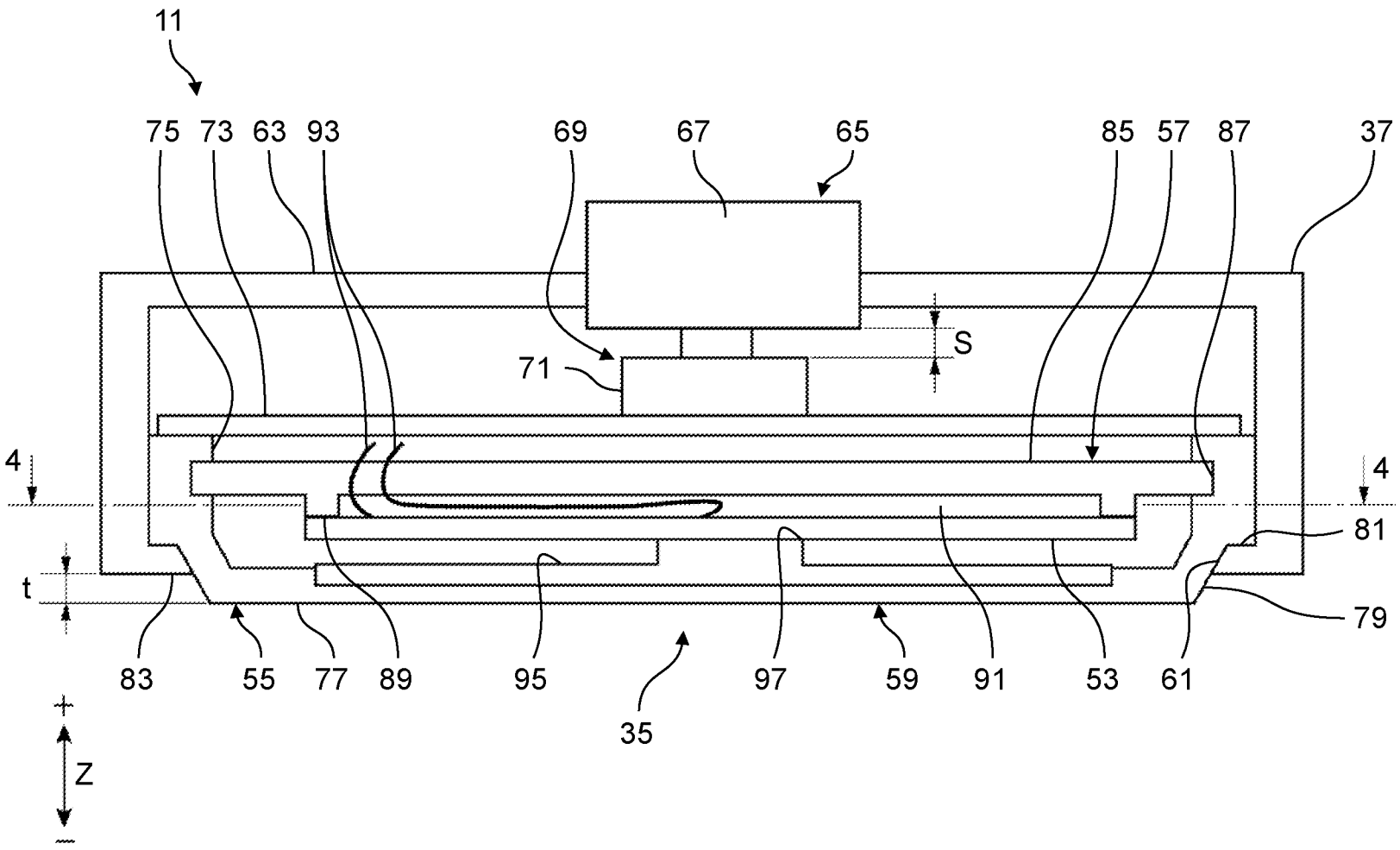
FIG. 3 is a sectional view of the bone conduction microphone illustrated in FIG. 2.

FIG. 3 is a sectional view of bone conduction microphone 11 illustrated in FIG. 2, taken along a plane in a direction perpendicular to piezoelectric element 53. Bone conduction microphone 11 according to the first exemplary embodiment mainly includes housing 37, microphone pad 55, element support member 57, piezoelectric element 53, and drive plate 59.

Housing 37 is formed in a flat bottomed cylindrical shape. Housing 37 includes opening 61 formed in an end surface on one end side in a direction along the axis. Housing 37 has an end surface opposite to opening 61, the end surface being closed by closing plate portion 63 in a circular shape. Closing plate portion 63 is provided at the center with call button 65 projecting outward from closing plate portion 63.

Call button 65 includes button 67 and switch 69. Button 67 and switch 69 are each formed in a circular shape or a rectangular shape, for example, and are disposed coaxially with housing 37. Button 67 protrudes outward from closing plate portion 63 by at least a distance of operation stroke S. Button 67 approaches and separates from fixed portion 71 of switch 69 within the distance of operation stroke S. Call button 65 is fixed when fixed portion 71 of switch 69 is mounted on board 73 described later. Call button 65 includes a spring incorporated between a fixed portion side and a button side, the spring pressing button 67 in a direction away from fixed portion 71 (the plus side in the Z direction). Call button 65 is, for example, a tactile switch that is continuously turned on when it is pressed and turned off when it is not pressed. Button 67 for switching between turning on and off has a stroke of about 0.2 mm, for example, in the Z direction. Call button 65 includes an opening-closing circuit of switch 69 that is electrically connected to a switch circuit on board 73. Call button 65 allows piezoelectric element 53 to acquire vocal cord vibration when switch 69 is turned on.

Microphone pad 55 formed in a bottomed cylindrical shape is attached to opening 61 of housing 37. Microphone pad 55 is an elastic body softer than housing 37, and is formed of a resin material such as silicon rubber. Microphone pad 55 is open on one side in a direction along the axis of tubular portion 75, and is closed on the other side to form bottom portion 77. Bottom portion 77 is connected to the other end of tubular portion 75 with tapered portion 79 having a diameter that is gradually reduced from tubular portion 75. Microphone pad 55 includes tubular portion 75 with an outer circumference fixed to an inner circumference of housing 37 at a position near opening 61. Tubular portion 75 is formed of a thick wall having a larger radial thickness than the other portions. Opening 61 of housing 37 is provided with flange portion 81 projecting radially inward. Flange portion 81 has an inner hole into which bottom portion 77 projecting from tubular portion 75 with tapered portion 79 in the axial direction (a minus side in the Z direction) is fitted while bottom portion 77 slightly projects outward from housing 37.

Thus, bone conduction microphone 11 is configured such that bottom portion 77 of microphone pad 55 projects outward from housing 37 by the amount of projection t through opening-formed surface 83 having opening 61 of housing 37.

Microphone pad 55 is configured to allow a surface of bottom portion 77 to come into contact with a skin surface. Although bone conduction microphone 11 according to the first exemplary embodiment is described for an example in which microphone pad 55 comes into contact with a skin surface near the pharynx of a wearer, the present invention is not limited thereto. Bone conduction microphone 11 may be configured to bring microphone pad 55 into contact with a skin surface near the nasal cavity of the wearer. That is, bone conduction microphone 11 can pick up vibration using pharyngeal vibration or nasal bone vibration based on utterance of the wearer.

Tubular portion 75 has an end surface to which board 73 in a circular shape is fixed, the end surface being opposite to bottom portion 77. Board 73 is provided with a circuit pattern formed by printing or the like. When board 73 is fixed to the end surface increased in thickness of tubular portion 75, an impact generated by operating call button 65 is absorbed by deformation in a direction along the axis of tubular portion 75. This causes vibration generated by operating call button 65 to be attenuated and transmitted to housing 37.

Element support member 57 in a circular shape is fixed to an inner circumference of tubular portion 75. Element support member 57 includes base plate 85 in the shape of a disk. Element support member 57 is fixed by fitting an outer circumference of base plate 85 into recessed inner peripheral groove 87 formed in the inner circumference of tubular portion 75.

Element support member 57 includes base plate 85 provided with a support portion projecting toward bottom portion 77. The support portion is formed of annular protrusion 89 concentric with base plate 85.

Figure 4:
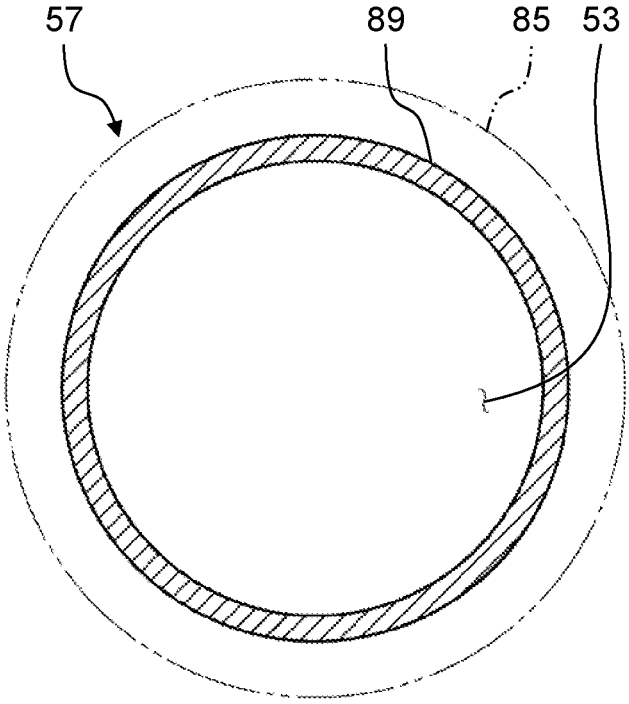
FIG. 4 is a sectional view taken along line 4-4 in FIG. 3.

FIG. 4 is a sectional view taken along line 4-4 in FIG. 3. Annular protrusion 89 is formed concentrically with base plate 85 on a surface of base plate 85 on a side facing bottom portion 77 of microphone pad 55. FIG. 4 shows a virtual circle drawn by a chain line outside annular protrusion 89, the virtual circle being an outer peripheral circle of base plate 85. As illustrated in FIG. 3, element support member 57 is fixed by fitting the outer circumference of base plate 85 into inner peripheral groove 87 formed in tubular portion 75 increased in thickness and formed of a soft elastic body. This causes element support member 57 to be less likely to transmit vibration generated by operating call button 65 from board 73 due to cushioning (damper) action of the elastic body.

Figure 5:
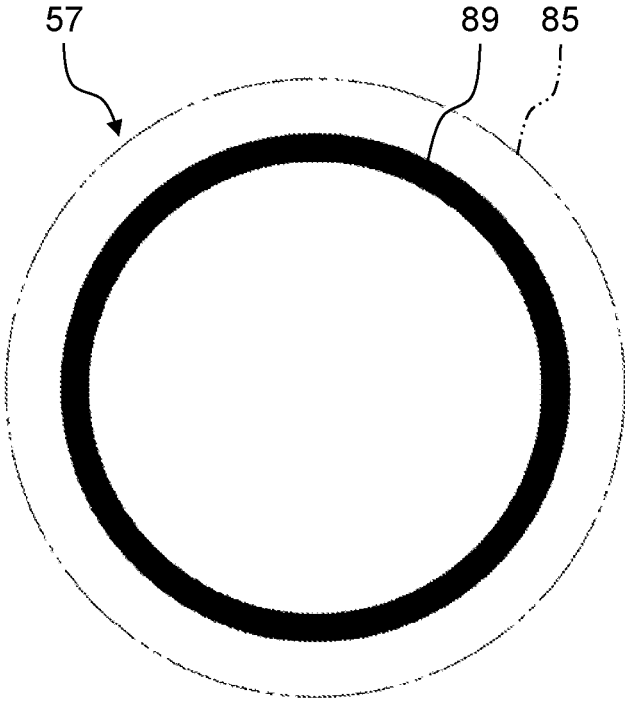
FIG. 5 is a plan view of an element support member illustrated in FIG. 4 as viewed from an annular protrusion side.

FIG. 5 is a plan view of element support member 57 illustrated in FIG. 4 as viewed from an annular protrusion side. Annular protrusion 89 is formed in the shape of a peripheral wall from base plate 85. Annular protrusion 89 is formed equal in radial thickness on the entire circumference. As illustrated in FIG. 3, annular protrusion 89 forms inside space 91 with a closed circumference.

Annular protrusion 89 has an upright leading end surface to which piezoelectric element 53 in the shape of a disk having an outer diameter substantially equal to an outer diameter of annular protrusion 89 is fixed. Piezoelectric element 53 picks up vibration when its peripheral edge of one surface is fixed to the protruding leading end surface of annular protrusion 89. Piezoelectric element 53 generates a potential in accordance with mechanical stress received due to picked up pharyngeal vibration or nasal bone vibration. Piezoelectric element 53 is connected to lead wire 93. Lead wire 93 passes through base plate 85 to be connected to a vibration detection circuit on board 73. The potential generated by piezoelectric element 53 is input to the vibration detection circuit on board 73 or the like.

Element support member 57 has annular protrusion 89, so that space 91 is formed between base plate 85 and piezoelectric element 53. Space 91 has a distance that is set such that piezoelectric element 53, which is displaced by vibration, does not come into contact with base plate 85.

Microphone pad 55 includes bottom portion 77 having an inward surface to which drive plate 59 is fixed. Drive plate 59 includes diaphragm part 95 and protrusion 97. Diaphragm part 95 is fixed to bottom portion 77. Diaphragm part 95 is provided at its central portion with protrusion 97 fixed to an element central portion on the other surface of piezoelectric element 53. Diaphragm part 95 and protrusion 97 are integrally formed of a material harder than microphone pad 55.

Bottom portion 77 of microphone pad 55 and diaphragm part 95 of drive plate 59 constitute vibration acquisition unit 35.

As described above, bone conduction microphone 11 includes vibration acquisition unit 35 that comes into contact with a human body (wearer) to acquire vocal cord vibration in a predetermined direction, piezoelectric element 53 that converts the vibration acquired by vibration acquisition unit 35 to an electric signal, and diaphragm part 95 large in area having protrusion 97 narrow in area in a contact portion with piezoelectric element 53.

Figure 6:
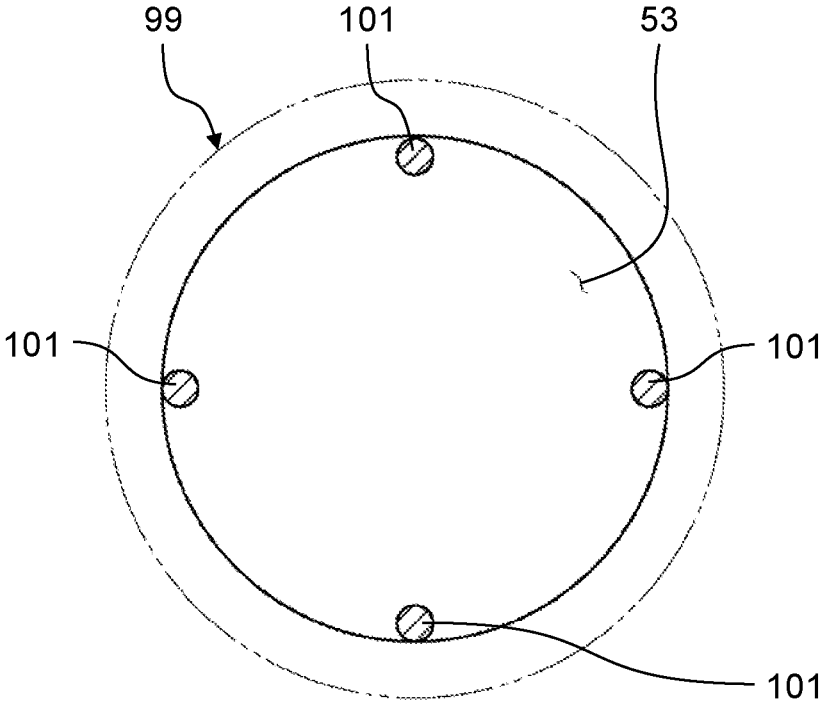
FIG. 6 is a sectional view illustrating a modification of the support portion.

FIG. 6 is a sectional view illustrating a modification of the support portion. Element support member 99 may have a support portion formed of three or more columns 101 disposed along the outer circumference of base plate 85.

Figure 7:
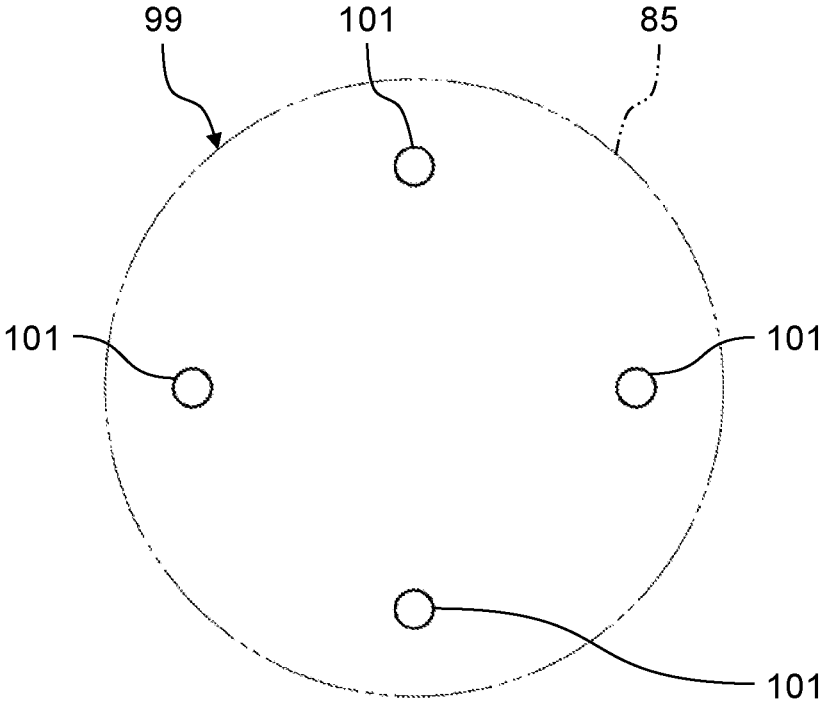
FIG. 7 is a plan view of the element support member illustrated in FIG. 6 as viewed from a support column side.

FIG. 6 is a plan view of element support member 99 illustrated in FIG. 7 as viewed from a column side. Although element support member 99 according to this modification has four columns 101, a number of columns 101 is not limited to this as long as it is three or more. Columns 101 are preferably disposed circumferentially at equal intervals.

In the first exemplary embodiment, bone conduction microphone 11 is formed of element support member 57, piezoelectric element 53, protrusion 97, and drive plate 59, which are disposed concentrically.

Although the above structure is described for an example in which element support member 57, piezoelectric element 53, protrusion 97, and drive plate 59 are each in a circular shape, element support member 57, piezoelectric element 53, protrusion 97, and drive plate 59 may be each an ellipse. In this case, element support member 57, piezoelectric element 53, protrusion 97, and drive plate 59 are each formed in a similar shape in which a minor axis and a major axis of each of multiple ellipses align.

Next, operation of bone conduction microphone 11 according to first exemplary embodiment described above will be described.

Bone conduction microphone 11 according to the first exemplary embodiment includes housing 37 with opening 61. Bone conduction microphone 11 includes microphone pad 55 in which an outer circumference of tubular portion 75 that is formed in a bottomed tubular shape and has bottom portion 77 disposed outward is fixed to an inner circumference of opening 61. Bone conduction microphone 11 includes element support member 57 that has an outer circumference fixed to the inner circumference of tubular portion 75 and the support portion protruding toward bottom portion 77. Bone conduction microphone 11 includes piezoelectric element 53 in a plate shape that has one surface with the peripheral edge fixed to the support portion and picks up vibration. Bone conduction microphone 11 includes drive plate 59 that has diaphragm part 95 fixed to an inward surface of bottom portion 77, and the diaphragm part is provided at the center with protrusion 97 fixed to an element central portion on the other surface of piezoelectric element 53.

Bone conduction microphone 11 according to the first exemplary embodiment includes piezoelectric element 53 that is fixed to element support member 57. Element support member 57 includes the support portion (annular protrusion 89 or support column 101) projecting toward bottom portion 77 of microphone pad 55, and the support portion has the protruding leading end that fixes the peripheral edge of one surface of piezoelectric element 53. The peripheral edge of piezoelectric element 53 is fixed by the support portion, so that the element central portion can be freely (largely) displaced as compared with the conventional structure in which the entire surface of piezoelectric element 53 is bonded to microphone pad 55.

Then, microphone pad 55 includes bottom portion 77 with an outer surface that comes into contact with a skin surface, and diaphragm part 95 of drive plate 59 is bonded to an inward surface of bottom portion 77, diaphragm part 95 being substantially equal in area to bottom portion 77. Diaphragm part 95 has a large area substantially equal to that of bottom portion 77 of microphone pad 55, and thus comes into wide contact with a skin surface for picking up vibration. Diaphragm part 95 in contact with the skin surface over a wide area receives vibration propagating from a wide range.

Figure 8:
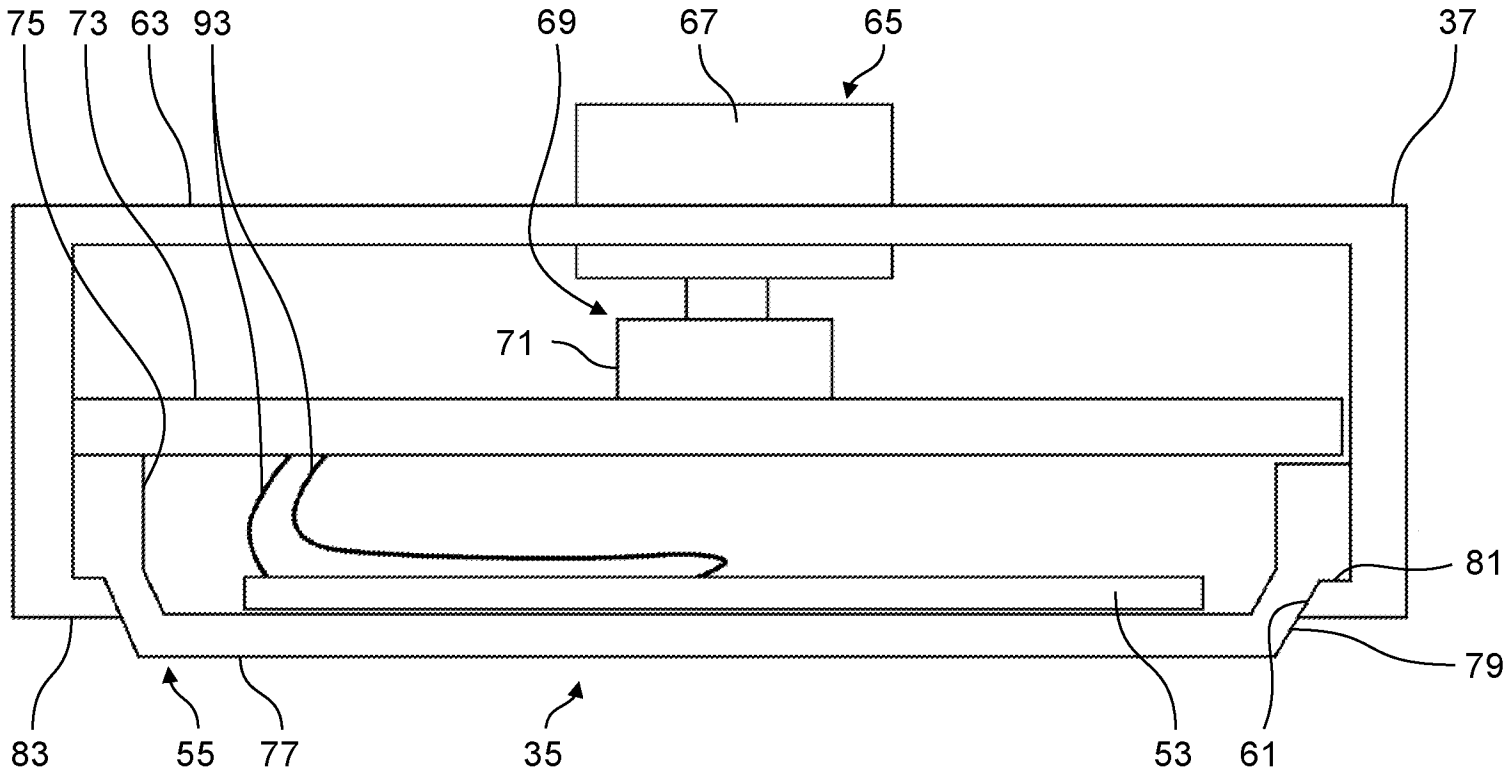
FIG. 8 is a sectional view of a full-face attachment structure according to a comparative example in which a piezoelectric element is bonded to a bottom portion of a pad.

FIG. 8 is a sectional view of a full-face attachment structure according to a comparative example in which piezoelectric element 53 is bonded to bottom portion 77 of microphone pad 55. As illustrated in FIG. 8, in the full-face attachment structure according to the comparative example in which the entire surface of piezoelectric element 53 is fixed to bottom portion 77 of microphone pad 55, bottom portion 77 in close contact with piezoelectric element 53 restricts free vibration of piezoelectric element 53. In contrast, bone conduction microphone 11 allows only the peripheral edge of piezoelectric element 53 to be fixed, so that the element central portion can be displaced most easily.

Then, bone conduction microphone 11 intensively transmits vibration propagating to diaphragm part 95 of drive plate 59 to the element central portion of piezoelectric element 53 using protrusion 97 (without leaking to other members). That is, bone conduction microphone 11 has a structure in which the element central portion does not come into contact with housing 37, and a diaphragm central portion of diaphragm part 95 with a contact surface increased in area to be in wide contact with a skin surface is intensively brought into contact with the element central portion.

This enables piezoelectric element 53 to efficiently pick up even slight vibration. That is, piezoelectric element 53 can output a potential even for small vibration. Piezoelectric element 53 can be deformed more than the conventional structure with respect to the same vibration, and thus can output a large potential.

Bone conduction microphone 11 includes call button 65 that is pressed when a wearer of bone conduction microphone 11 talks and that is provided in housing 37.

Element support member 57 supporting piezoelectric element 53 has an outer circumference that is only fixed to housing 37 with microphone pad 55. Element support member 57 having the fixed outer circumference fixes only the peripheral edge of piezoelectric element 53 with the support portion. Thus, vibration from housing 37 when call button 65 is operated is transmitted to the peripheral edge of piezoelectric element 53 through tubular portion 75, element support member 57, and the support portion. In this way, bone conduction microphone 11 has a path (structure) of vibration transmitted from housing 37 to piezoelectric element 53, the path increasing as compared with the conventional full-face attachment structure (vibration transmission medium increases in mass). This structure acts to suppress (attenuate) propagation of the vibration. As a result, bone conduction microphone 11 can suppress a phenomenon in which vibration of housing 37 caused by pressing button 67 is picked up by piezoelectric element 53. Call button 65 may or may not be provided on housing 37.

Thus, bone conduction microphone 11 according to the first exemplary embodiment enables increasing a potential level of piezoelectric element 53 as compared with the conventional structure, and reducing a phenomenon in which vibration caused by pressing call button 65 is heard by the other party.

Bone conduction microphone 11 is configured such that element support member 99 includes base plate 85 in a circular or elliptical shape, with an outer circumference fixed to the inner circumference of tubular portion 75, and the support portion is formed of similar annular protrusion 89 in a circular shape concentric with base plate 85 or an elliptical shape with a minor axis and a major axis aligning with those of base plate 85.

This bone conduction microphone 11 includes annular protrusion 89 serving as the support portion. Annular protrusion 89 is provided projecting from a surface of base plate 85 disposed parallel to piezoelectric element 53, the surface facing the piezoelectric element. Annular protrusion 89 fixes the peripheral edge of piezoelectric element 53 with the protruding leading end surface thereof. Piezoelectric element 53 fixed to annular protrusion 89 is evenly fixed to the protruding leading end surface of annular protrusion 89 over the entire circumference along an outer shape (contour). Piezoelectric element 53 having the entire circumference of the peripheral edge fixed evenly is less likely to cause variation in tension. This causes piezoelectric element 53 to be less likely to have slack or the like (difference in tension) that damps vibration, so that the vibration efficiently propagates from drive plate 59.

Bone conduction microphone 11 may be configured such that element support member 99 includes base plate 85 in a circular or elliptical shape, with an outer circumference fixed to the inner circumference of tubular portion 75, and the support portion is formed of three or more columns 101 disposed along the outer circumference of base plate 85.

Bone conduction microphone 11 may be configured such that the peripheral edge of piezoelectric element 53 is fixed to leading end surfaces of multiple columns 101, each having a small contact area, provided on element support member 99. Element support member 99 can support piezoelectric element 53 with a smaller fixed area than an annular support portion. This prevents piezoelectric element 53 from diffusing vibration energy transferred from drive plate 59 to other members as compared with the conventional full-face attachment structure. As a result, piezoelectric element 53 can suppress attenuation of vibration having propagated, and enables smaller vibration to contribute to deformation (i.e., generation of a potential).

Bone conduction microphone 11 picks up vibration that is pharyngeal vibration or nasal bone vibration based on utterance of a wearer of bone conduction microphone 11.

This bone conduction microphone 11 enables diaphragm part 95 of drive plate 59 to pick up the pharyngeal vibration or the nasal bone vibration caused by propagation of vocal cord vibration. Diaphragm part 95 is bonded to an inward surface of microphone pad 55. Microphone pad 55 is disposed with an outward surface opposite to the inward surface to which diaphragm part 95 is fixed, the outward surface being in contact with a skin surface of a pharynx or a nasal cavity. Bone conduction microphone 11 propagates vibration of bone in the pharynx or the nasal cavity to diaphragm part 95 of drive plate 59, and the vibration of diaphragm part 95 drives piezoelectric element 53 using protrusion 97. Bone conduction microphone 11 converts a potential generated by deformation due to this mechanical vibration into a voice signal and outputs it.

Bone conduction microphone 11 is configured such that bottom portion 77 of microphone pad 55 projects outward from housing 37 further than opening-formed surface 83 having opening 61 of housing 37.

This bone conduction microphone 11 allows bottom portion 77 of microphone pad 55 to project from housing 37, so that only bottom portion 77 of microphone pad 55 can be reliably brought into close contact with the skin surface during wearing. This enables reducing vibration that is not picked up due to bottom portion 77 separating from the skin surface. When bottom portion 77 of microphone pad 55 projects, housing 37 and diaphragm part 95 are separated from each other by a distance defined by tapered portion 79. This enables vibration from housing 37 caused by pressing button 67 to be further less likely to propagate to diaphragm part 95 as compared with when bottom portion 77 is flush with opening 61.

Bone conduction microphone 11 has space 91 between base plate 85 and piezoelectric element 53 at a distance preventing piezoelectric element 53 displaced by vibration from coming into contact with base plate 85.

Bone conduction microphone 11 is configured such that space 91 is provided between piezoelectric element 53 and base plate 85. Even when piezoelectric element 53 is displaced due to vibration, contact with base plate 85 is avoided by this space 91. This enables piezoelectric element 53 to efficiently convert vibration having propagated into a potential without attenuating the vibration unnecessarily.

Microphone pad 55 is configured such that when bottom portion 77 projecting from housing 37 is pressed against the skin surface to ensure adhesion, diaphragm part 95 fixed to bottom portion 77 is displaced in a direction approaching piezoelectric element 53. Piezoelectric element 53 is deformed toward base plate 85 by protrusion 97 of diaphragm part 95 approaching. Even in this case, interference between piezoelectric element 53 and base plate 85 can be avoided using space 91 while a good adhesion state of microphone pad 55 is ensured. That is, space 91 also serves as a retracting space for piezoelectric element 53 that is displaced when microphone pad 55 is pressed.

Bone conduction microphone 11 is configured such that element support member 57, piezoelectric element 53, protrusion 97, and drive plate 59 are each formed in a concentric circular shape, or are formed in similar elliptical shapes with aligned minor axes and aligned major axes.

Bone conduction microphone 11 is configured such that a plurality of vibration transmitting members for transmitting vibration is disposed point-symmetrically about protrusion 97. Respective vibration transmitting members are connected to each other at portions where the respective vibration transmitting members are displaced most. This enables bone conduction microphone 11 to propagate vibration to piezoelectric element 53 more efficiently as compared with when protrusion 97 is fixed near the peripheral edge of piezoelectric element 53, for example.

Although various exemplary embodiments have been described above with reference to the drawings, it is needless to say that the present disclosure is not limited to such examples. It is obvious to those skilled in the art that various modification examples, modification examples, substitution examples, addition examples, deletion examples, and equivalent examples can be conceived within the scope of claims, and thus it is obviously understood that those examples belong to the technical scope of the present disclosure. Additionally, each component in the various exemplary embodiments described above may be appropriately combined without departing from the spirit of the invention.

The present disclosure is useful as a bone conduction microphone that increases a potential level output by a piezoelectric element and suppresses an occurrence of a phenomenon in which vibration caused by pressing a call button is heard by the other party as an unpleasant sound.

What is claimed is:

1. A bone conduction microphone comprising:

a housing having an opening;

a microphone pad formed in a bottomed tubular shape having a bottom portion disposed outward and a tubular portion with an outer circumference fixed to an inner circumference of the opening;

an element support member that has an outer circumference fixed to an inner circumference of the tubular portion, and a support portion projecting toward the bottom portion;

a piezoelectric element that is in a plate shape with a peripheral edge of one surface fixed to the support portion and picks up vibration; and a drive plate that has a diaphragm part fixed to an inward surface of the bottom portion, the diaphragm part being provided at a center with a protrusion fixed to an element central portion on another surface of the piezoelectric element.

2. The bone conduction microphone according to claim 1, wherein the element support member includes a base plate in a circular or elliptical shape, with an outer circumference fixed to the inner circumference of the tubular portion, and the support portion is formed of a similar annular protrusion in a circular shape concentric with the base plate or an elliptical shape with a minor axis and a major axis aligning with those of the base plate.

3. The bone conduction microphone according to claim 1, wherein the element support member includes a base plate in a circular or elliptical shape, with an outer circumference fixed to the inner circumference of the tubular portion, and the support portion is formed of three or more columns disposed along the outer circumference of the base plate.

4. The bone conduction microphone according to claim 1, wherein the vibration is pharyngeal vibration or nasal bone vibration based on utterance of a wearer of the bone conduction microphone.

5. The bone conduction microphone according to claim 1, wherein the bottom portion projects outward from the housing further than an opening-formed surface in which the opening is formed.

6. The bone conduction microphone according to claim 2, wherein a space is provided between the base plate and the piezoelectric element at a distance preventing the piezoelectric element displaced by the vibration from coming into contact with the base plate.

7. The bone conduction microphone according to claim 3, wherein a space is provided between the base plate and the piezoelectric element at a distance preventing the piezoelectric element displaced by the vibration from coming into contact with the base plate.

8. The bone conduction microphone according to claim 1, wherein the element support member, the piezoelectric element, the protrusion, and the drive plate are each formed in a concentric circular shape, or are formed in similar elliptical shapes with aligned minor axes and aligned major axes.

9. The bone conduction microphone according to claim 1, wherein the housing includes a call button.

* * * * *